US011716581B2

(12) United States Patent
Peng et al.

(10) Patent No.: US 11,716,581 B2
(45) Date of Patent: Aug. 1, 2023

(54) MEDICAL HEARING-AID EARPHONE

(71) Applicant: MERRY ELECTRONICS(SUZHOU) CO., LTD., Suzhou (CN)

(72) Inventors: Yuanqiao Peng, Suzhou (CN); Guanghong Yu, Suzhou (CN); Xu Liu, Suzhou (CN); Xiaolong Liu, Suzhou (CN)

(73) Assignee: MERRY ELECTRONICS(SUZHOU) CO., LTD., Suzhou (CN)

( * ) Notice: Subject to any disclaimer, the term of this patent is extended or adjusted under 35 U.S.C. 154(b) by 246 days.

(21) Appl. No.: 17/141,469

(22) Filed: Jan. 5, 2021

(65) Prior Publication Data

US 2021/0377676 A1 Dec. 2, 2021

(30) Foreign Application Priority Data

May 28, 2020 (CN) ..... 202010467562.2

(51) Int. Cl.
*H04R 25/00* (2006.01)

(52) U.S. Cl.
CPC ..... *H04R 25/65* (2013.01); *H04R 2225/77* (2013.01)

(58) Field of Classification Search
CPC ..... H04R 25/00; H04R 25/60; H04R 1/1016
USPC ..... 381/312, 322, 324, 328
See application file for complete search history.

(56) References Cited

U.S. PATENT DOCUMENTS 6,700,983 B1 * 3/2004 Boegeskov-Jensen et al. ..... H04R 25/60 381/322
2018/0332378 A1 * 11/2018 Guo ..... H04R 1/1016
2019/0297426 A1 9/2019 Xue et al.

FOREIGN PATENT DOCUMENTS

| | | | |
|---|---|---|---|
| CN | 102300138 | A | 12/2011 |
| CN | 204305272 | U | 4/2015 |
| CN | 204498338 | U | 7/2015 |
| CN | 104967957 | A | 10/2015 |
| CN | 204859501 | U | 12/2015 |
| CN | 206932365 | U | 1/2018 |
| CN | 108600922 | A | 9/2018 |
| CN | 110636401 | A | 12/2019 |
| CN | 210093463 | U | 2/2020 |

(Continued)

OTHER PUBLICATIONS

Chinese Office Action and Search Report for Chinese Application No. 202010467562.2, dated Jan. 26, 2021, with English translation.

*Primary Examiner* — George C Monikang
(74) *Attorney, Agent, or Firm* — Birch, Stewart, Kolasch & Birch, LLP

(57) ABSTRACT

A medical hearing-aid earphone includes a housing, and a battery assembly and a circuit board assembly located in the housing, where the housing is internally provided with a sound cavity, and the medical hearing-aid earphone further includes a speaker assembly located in the housing and a holder sleeved outside the speaker assembly. The holder and the speaker assembly divide the sound cavity into a front sound cavity and a rear sound cavity, where a relative position of the speaker assembly in the holder is adjustable during assembling. The medical hearing-aid earphone is convenient to adjust space sizes of a front sound cavity and a rear sound cavity, so that the medical hearing-aid earphone (Continued)

can be customized according to requirements of different users and has a larger application range.

13 Claims, 8 Drawing Sheets

(56) References Cited

FOREIGN PATENT DOCUMENTS

CN 210129948 U 3/2020

* cited by examiner

MEDICAL HEARING-AID EARPHONE

CROSS-REFERENCE TO RELATED APPLICATION

This application claims priority to Chinese Patent Application No. 202010467562.2 filed May 28, 2020, the disclosure of which is incorporated herein by reference in its entirety.

TECHNICAL FIELD

The present disclosure relates to the technical field of earphones and, in particular, to a medical hearing-aid earphone.

BACKGROUND

An earphone can receive electric signals from a media player or receiver, and use a speaker close to an ear to convert the electric signals into sound waves that can be heard by human ears. At present, the earphone is also applied to a medical hearing-aid industry, so that the earphone needs to be equipped with various structures to satisfy requirements of different customers.

The earphone includes a front sound cavity and a rear sound cavity, and space sizes of the front sound cavity and the rear sound cavity can affect a sound wave range of the earphone. In the existing art, the front sound cavity and the rear sound cavity are separated by a speaker, and an overall size of the earphone and a structure and size of the speaker are predetermined, so that it is difficult to adjust the space sizes of the front sound cavity and the rear sound cavity, which makes it difficult for the earphone in the related art to achieve personal tailor. That is, the earphone in the existing art has a small application range and cannot meet the requirements.

SUMMARY

The present disclosure provides a medical hearing-aid earphone, which is convenient to adjust space sizes of a front sound cavity and a rear sound cavity, so that the medical hearing-aid earphone can be customized according to requirements of different users and thus has a larger application range.

As conceived as above, the present disclosure provides the technical solutions described below.

A medical hearing-aid earphone includes a housing, a battery assembly and a circuit board assembly located in the housing, where the housing is internally provided with a sound cavity. The medical hearing-aid earphone further includes a speaker assembly located in the housing and a holder sleeved outside the speaker assembly, where the holder and the speaker assembly divide the sound cavity into a front sound cavity and a rear sound cavity, and a relative position of the speaker assembly in the holder is adjustable during assembling.

Optionally, the holder includes a first part and a second part connected to each other, where the first part is provided with a first through hole, the speaker assembly is located in the first through hole, the second part is provided with a second through hole communicating with the first through hole, a cross-sectional dimension of the second through hole is smaller than a cross-sectional dimension of the first through hole, and the second through hole forms the front sound cavity.

Optionally, the second through hole includes a first hole section, a transitional section and a second hole section, where a cross-sectional dimension of the first hole section is larger than a cross-sectional dimension of the second hole section, and the first hole section communicates with the first through hole.

Optionally, the first through hole, the first hole section and the second hole section each are a cylindrical hole, and the transitional section is a conical hole.

Optionally, where the housing includes an upper housing and a lower housing connected to each other, the sound cavity is formed in the upper housing and the lower housing, the lower housing is internally provided with a support part, the support part is matched with the second par to support the second part.

Optionally, the lower housing is provided a third through hole, and the medical hearing-aid earphone further includes a sound output tube located in the third through hole, and a communicating tube for communicating the speaker assembly and the sound output tube, where the sound output tube is fixed on the holder.

Optionally, an outer surface of the holder is provided with a groove, and the communicating tube is located in the groove.

REFERENCE LIST

Figure 1:
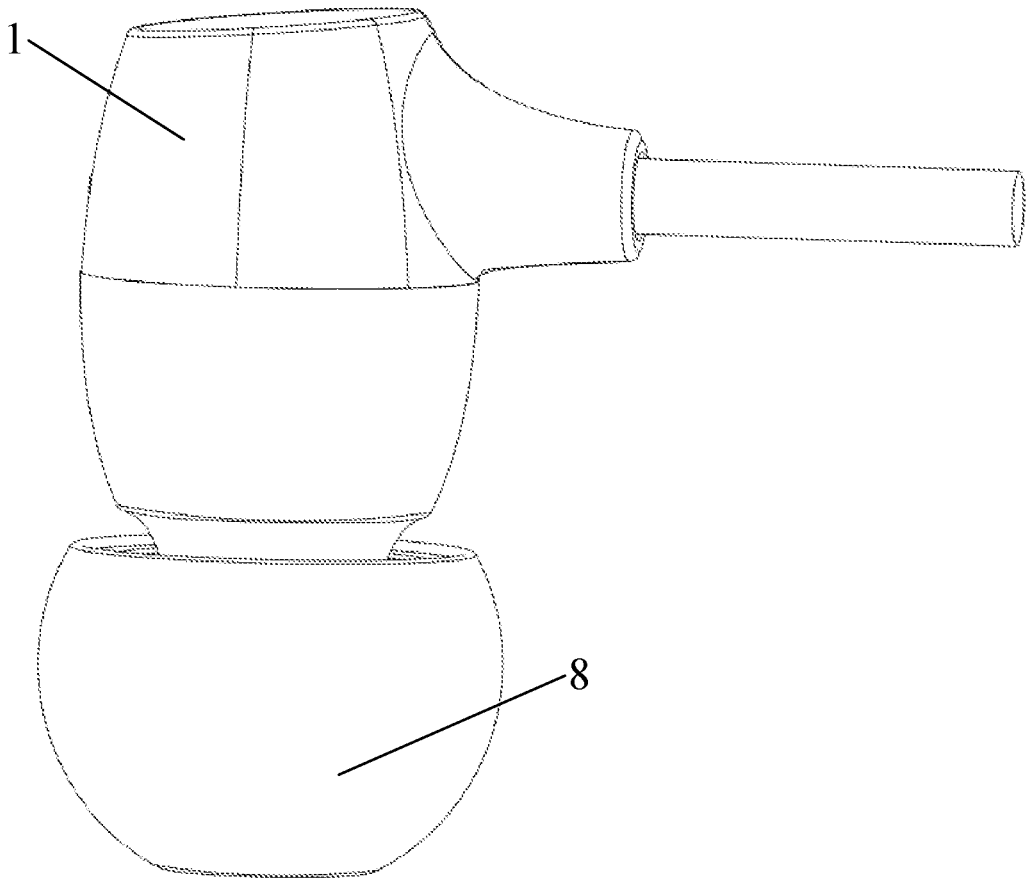
FIG. 1 is a structural view of a medical hearing-aid earphone according to an embodiment of the present disclosure.

1 housing
11 upper housing
12 lower housing
121 support part
122 third through hole
2 circuit board assembly
3 speaker assembly
4 holder
41 first part
411 first through hole
412 step structure

42 second part
421 second through hole
4211 first hole section
4212 transitional section
4213 second hole section
43 groove
51 front sound cavity
52 rear sound cavity
6 sound output tube
7 communicating tube
8 ear cap
9 moving coil assembly

DETAILED DESCRIPTION

To make solved problems, adopted solutions and achieved effects of the present disclosure clearer, the solution of the present disclosure is further described in conjunction with accompanying drawings and an embodiment. It is to be understood that the specific embodiments set forth below are intended to illustrate and not to limit the present disclosure. For ease of description, only a part, not all, related to the present disclosure is illustrated in the accompanying drawings.

In the description of the present disclosure, it should be understood that the orientational or positional relationships indicated by terms "center", "above", "below", "left", "right", "vertical", "horizontal", "inside", "outside" and the like are based on the orientational or positional relationships illustrated in the drawings, which are for the mere purpose of facilitating and simplifying the description of the present disclosure, and these relationships do not indicate or imply that the device or component referred to has a specific orientation and is constructed and operated in a specific orientation, and thus it is not to be construed as limiting the present disclosure. Moreover, terms like "first" and "second" are merely used for the description and are not to be construed as indicating or implying relative importance.

In the description of the present disclosure, it should be noted that unless otherwise expressly specified and limited, terms like "mounted", "connected to each other", "connected" are to be construed in a broad sense, for example, as permanently connected, detachably connected; mechanically connected or electrically connected; directly connected or indirectly connected via an intermediate medium; or internally connected between two elements. For those skilled in the art, the preceding terms can be construed depending on specific contexts.

The embodiment provides a medical hearing-aid earphone, which can adjust sizes of a front sound cavity and a rear sound cavity by adjusting a shape of a holder.

As shown in FIGS. 1 to 10, the medical hearing-aid earphone includes a housing 1, a circuit board assembly 2, a speaker assembly 3 and a holder 4.

The circuit board assembly 2 is located in the housing 1, and the housing 1 is internally provided with a sound cavity, where the sound cavity refers to free space, in which no object is placed, in the housing 1. The speaker assembly 3 is located in the housing 1, specifically, the speaker assembly 3 is located below the circuit board assembly 2 and is electrically connected to the circuit board assembly 2.

Figure 8:
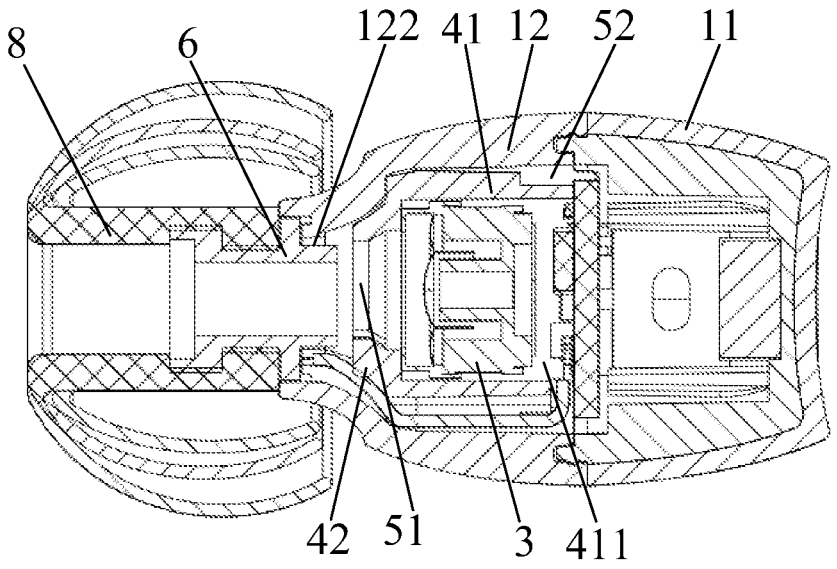
FIG. 8 is a cross-sectional view taken along a line A-A of the medical hearing-aid earphone shown in FIG. 7 according to the embodiment of the present disclosure.
Figure 9:
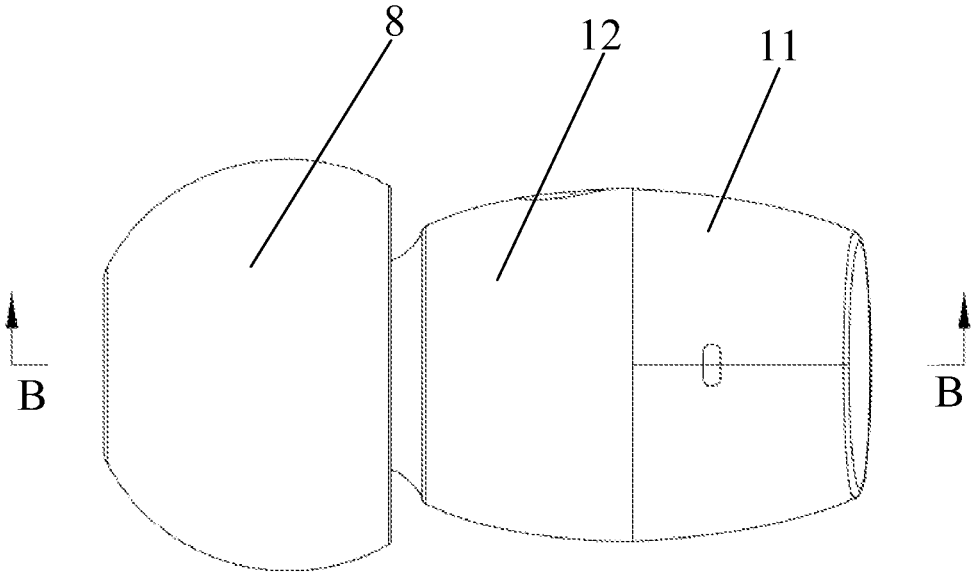
FIG. 9 is a top view of a medical hearing-aid earphone according to an embodiment of the present disclosure.

The holder 4 is sleeved outside the speaker assembly 3, and the holder 4 and the speaker assembly 3 divide the sound cavity into a front sound cavity 51 and a rear sound cavity 52 (as shown in FIG. 8).

The medical hearing-aid earphone provided by the embodiment can divide the sound cavity into the front sound cavity 51 and the rear sound cavity 51 through the holder 4, and be convenient to adjust the space sizes of the front sound cavity 51 and the rear sound cavity 52 by providing the holder 4 having different structures or dimensions or adjusting the relative position of the speaker assembly 3 in the holder 4, so as to achieve the object of adjusting the front sound cavity 51 or the rear sound cavity 52. Therefore, the medical hearing-aid earphone can be customized according to the requirements of different users, thus achieving private custom, and further enabling the medical hearing-aid earphone to have the larger application range.

In addition, the holder 4 in the embodiment is a separate component. In a case where the user wants to modify the space sizes of the front sound cavity 51 or the rear sound cavity 52, an original holder 4 can be replaced or trimmed into a holder 4 satisfying the requirements without purchasing a new medical hearing-aid earphone, thus reducing the cost of modifying the space sizes of the front sound cavity 51 or the rear sound cavity 52 and facilitating the recycling of the medical hearing-aid earphone.

Optionally, the holder 4 may be fine-tuned by three dimensional (3D) printing, such as adjusting the size and structure of the holder 4, or adjusting the relative position of the speaker assembly 3 in the holder 4, so as to achieve arbitrary adjustment of the sizes of the front sound cavity 51 or the rear sound cavity 52 and facilitate use.

Figure 4:
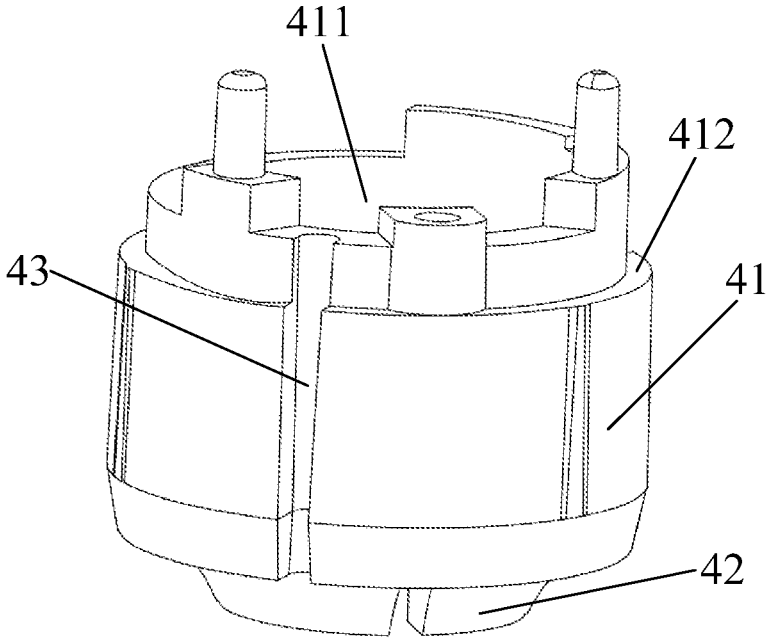
FIG. 4 is a structural view of a holder according to an embodiment of the present disclosure.
Figure 5:
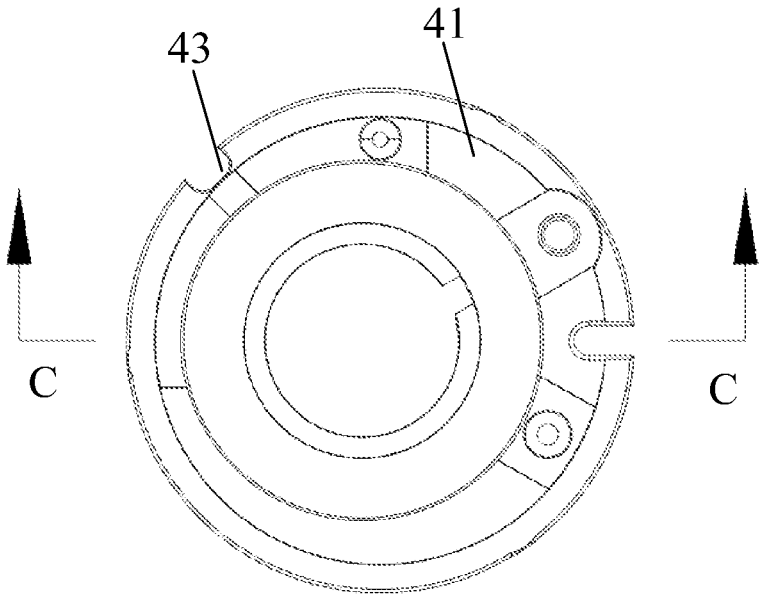
FIG. 5 is a top view of a holder according to an embodiment of the present disclosure.

Optionally, as shown in FIG. 4, the holder 4 may include a first part 41 and a second part 42 connected to each other. The first part 41 is provided with a first through hole 411, the speaker assembly 3 is located in the first through hole 411, and the second part 42 is provided with a second through hole 421 communicating with the first through hole 411. A cross-sectional dimension of the second through hole 421 is smaller than a cross-sectional dimension of the first through hole 411, and the second through hole 421 forms the front sound cavity 51. The first through hole 411 and the second through hole 421 each may be a cylindrical hole. In this case, the first through hole 411 has a circular cross-section, and the cross-sectional dimension of the first through hole 411 is a diameter of the circular cross-section; and the second through hole 421 has a circular cross-section, and the cross-sectional dimension of the second through hole 421 is a diameter of the cross-section. Optionally, the first through hole 411 and the second through hole 421 may further be a square cylindrical hole. In this case, the first through hole 411 and the second through hole 421 each have a square cross-section, and the cross-sectional dimension of the first through hole (or the second through hole 421) is a side length of the square cross-section. It is to be noted that in the embodiment, the cross-sectional dimension of the first through hole 411 corresponds to the cross-sectional dimension of the second through hole 421, such as length to length, width to width and diameter to diameter.

Figure 6:
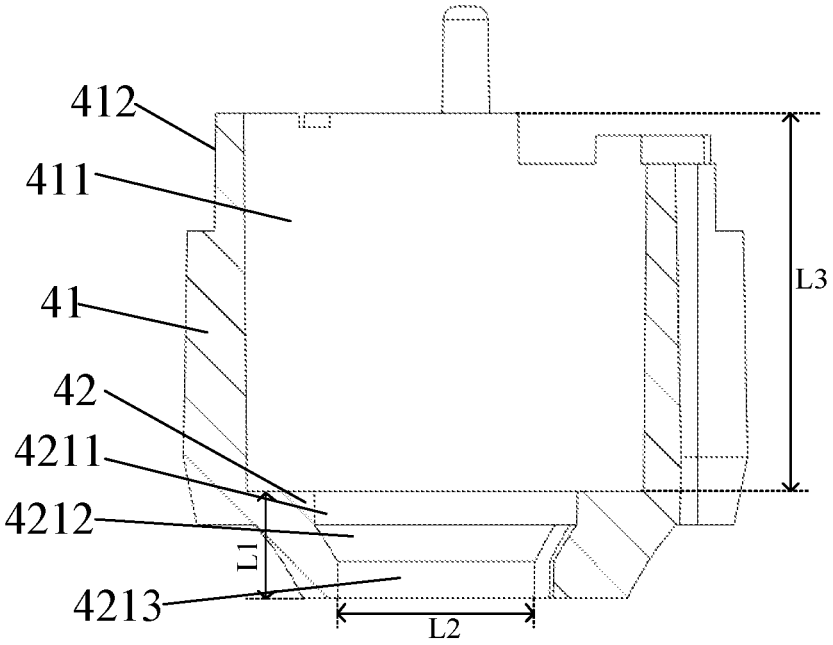
FIG. 6 is a cross-sectional view taken along a line C-C of the holder shown in FIG. 5 according to the embodiment of the present disclosure.
Figure 7:
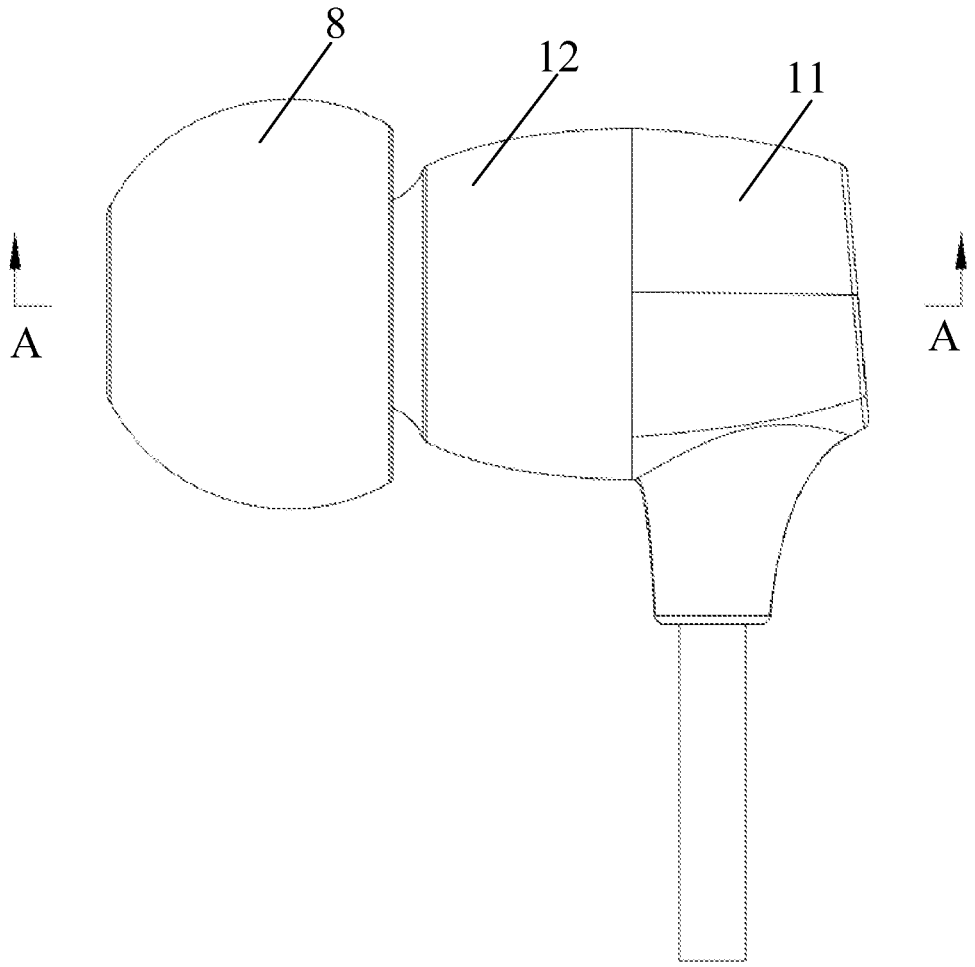
FIG. 7 is a front view of a medical hearing-aid earphone according to an embodiment of the present disclosure.

Further, as shown in FIG. 6, the second through hole 421 includes a first hole section 4211, a transitional section 4212 and a second hole section 4213. A cross-sectional dimension of the first hole section 4211 is larger than a cross-sectional dimension of the second hole section 4213, and the first hole section 4211 communicates with the first through hole 411. That is, the second through hole 421 is gradually narrowed along a direction far away from the first through hole 411 to fit a shape of the housing 1, so as to facilitate the connection of the housing 1 to an ear cap 8 in the medical hearing aid earphone.

Optionally, as shown in FIG. 6, the first through hole 411, the first hole section 4211 and the second hole section 4213 each are the cylindrical hole, and the transitional section 4212 is a conical hole, which facilitates the manufacture of the holder 4.

In the embodiment, the space size of the front sound cavity 51 can be adjusted by the dimensions of the first hole section 4211 and the second hole section 4213. Exemplarily, in a case where it is necessary to increase the space of the front sound cavity 51, the second hole section 4213 can be enlarged, such as thinning a part where the second hole section 4213 is located; or, a length of the second hole section 4213 may also be extended. Optionally, a length L1 of the second through hole 421 in an extending direction of the second through hole 421 is 0.5 to 1.5 times an inner diameter L2 of the second hole section 4213.

Optionally, a length L3 of the first through hole 411 in an extending direction of the first through hole 411 is 1.5 to 4 times the length L1 of the second through hole 421 in the extending direction of the second through hole 421, and such configuration can satisfy the requirements of most users.

In the embodiment, with reference to FIGS. 4 and 6, an outer surface of an end of the first part 41 far away from the second part 42 is provided with a step structure, and the space size of the rear sound cavity 52 can be adjusted by adjusting the step number and dimension of the step structure. If it is necessary to reduce the space size of the rear sound cavity 52, the step number of the step structure may be increased, or the step structure may also be filled.

Figure 2:
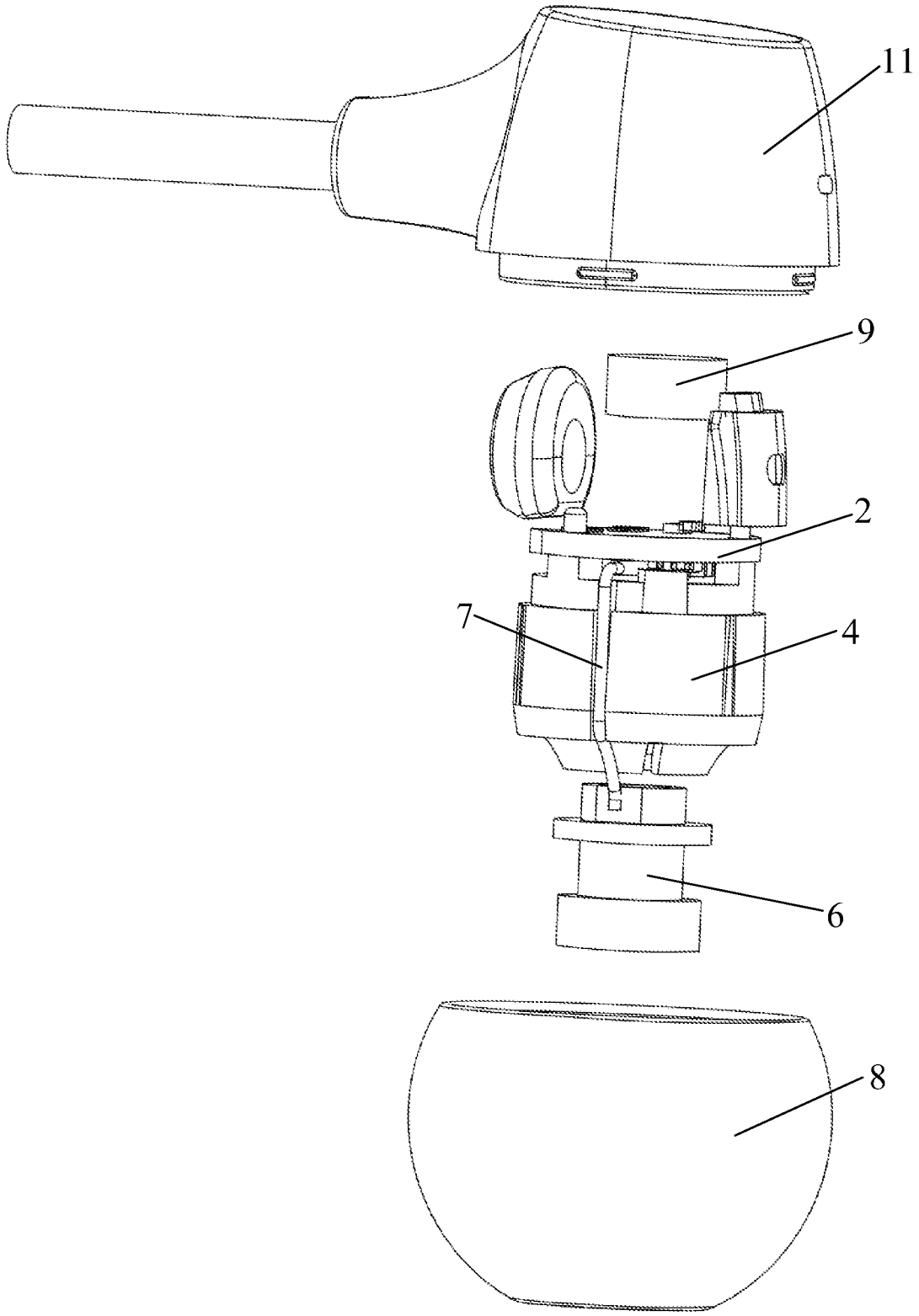
FIG. 2 is an exploded view 1 of a medical hearing-aid earphone according to an embodiment of the present disclosure.
Figure 3:
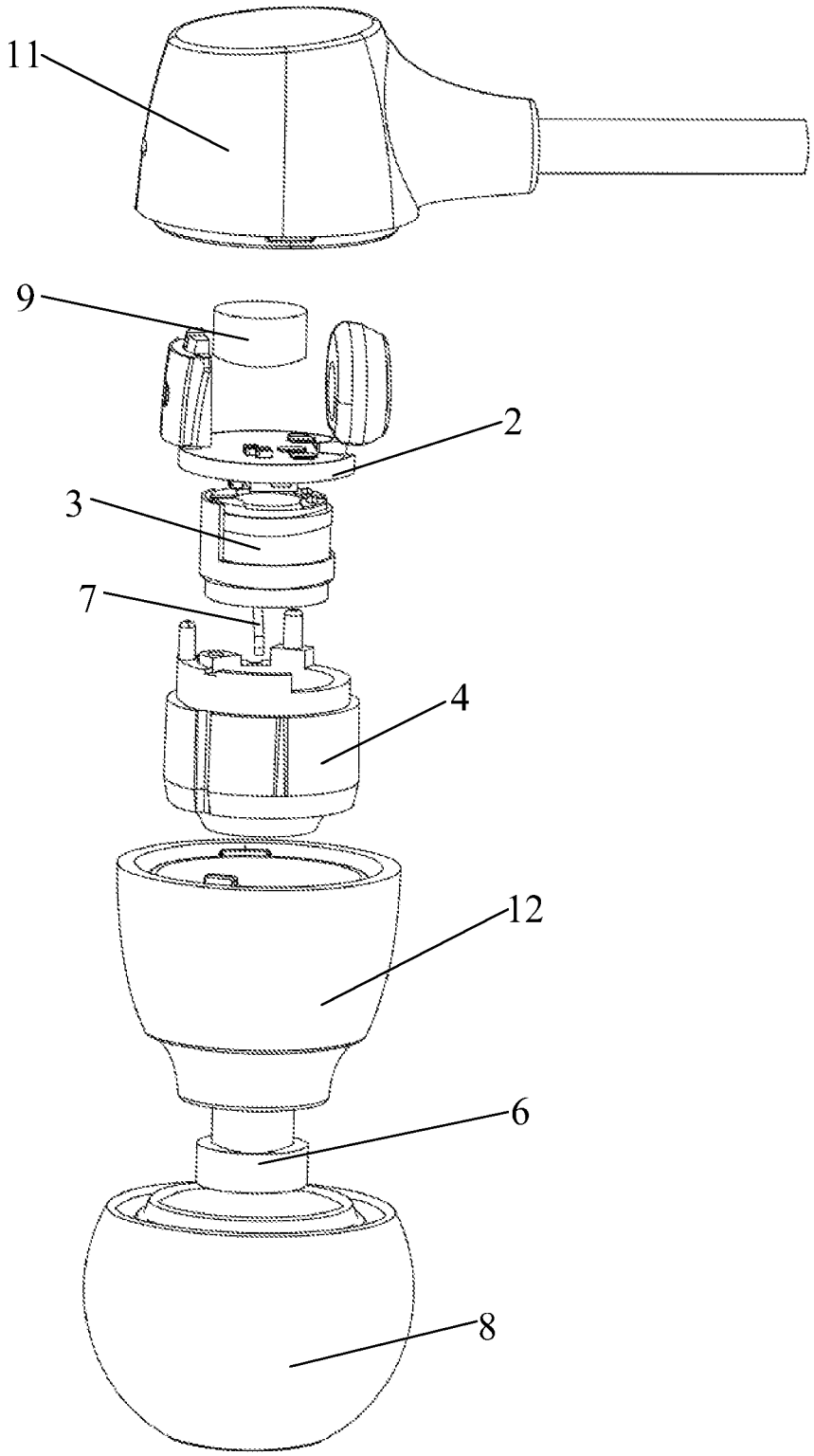
FIG. 3 is an exploded view 2 of a medical hearing-aid earphone according to an embodiment of the present disclosure.

In the embodiment, as shown in FIGS. 2 and 3, the housing 1 may include an upper housing 11 and a lower housing 12 connected to each other. The upper housing 11 is provided with a first recess facing towards the lower housing 12, the lower housing 12 is provided with a second recess facing towards the upper housing 11, and the first recess and the second recess form the above-mentioned sound cavity.

Figure 10:
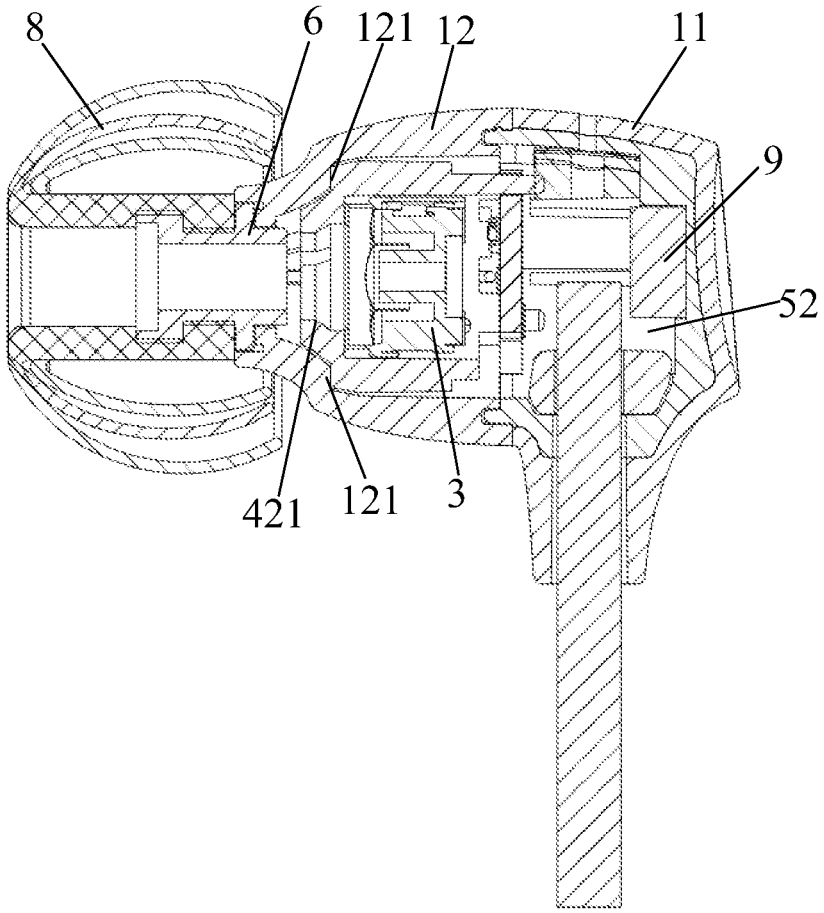
FIG. 10 is a cross-sectional view taken along a line B-B of the medical hearing-aid earphone shown in FIG. 9 according to the embodiment of the present disclosure.

Further, as shown in FIG. 10, the lower housing 12 is internally provided with a support part 121, and the support part 121 is matched with the second part 42. Specifically, the support part 121 is provided with a platform facing towards the holder 4, a middle part of the second part 42 of the holder 4 is provided with a bottom wall matching with the platform, and the support part 121 supports the second part 42 of the holder 4 through the platform and the bottom wall, so that the holder 4 can be stably located in the housing 1.

Optionally, as shown in FIG. 8, an end of the lower housing 12 far away from the upper housing 11 is provided a third through hole 122, and the medical hearing-aid earphone further includes a sound output tube 6 located in the third through hole 122, and a communicating tube 7 communicated with the speaker assembly 3 and the sound output tube 6. An end of the sound output tube 6 is fixed on the holder 4, specifically, the end of the sound output tube 6 is located in the second part 42 of the holder 4 and engages with the second part 42, and the other end of the sound output tube 6 is used for engaging with the ear cap 8, so that the ear cap 8 can be detachably connected to the sound output tube 6, thereby facilitating the replacement of the ear cap 8.

Further, as shown in FIG. 4, an outer surface of the holder 4 is provided with a groove 43, the groove 43 extends along a lengthwise direction of the holder 4, and the above-mentioned communicating tube 7 is located in the groove 43 and can stuck in the groove 43.

Optionally, referring to FIG. 2, the medical hearing-aid earphone may also include a moving coil assembly 9, a rechargeable battery, etc. located in the housing 1 to ensure normal use of the medical hearing-aid earphone.

The above embodiments describe only the basic principles and characteristics of the present disclosure and the present disclosure is not limited to the above embodiments. Various modifications and changes may be made in the present disclosure without departing from the spirit and scope of the present disclosure. These modifications and changes fall within the scope of the present disclosure. The scope of the present disclosure is defined by the appended claims and equivalents thereof.

What is claimed is:

1. A medical hearing-aid earphone, comprising: a housing, and a battery assembly and a circuit board assembly located in the housing, wherein the housing is internally provided with a sound cavity, and the medical hearing-aid earphone further comprises:

a speaker assembly, which is located in the housing; and a holder, which is a separate component integrally supported in the housing and sleeved outside the speaker assembly, and the holder and the speaker assembly divide the sound cavity into a front sound cavity and a rear sound cavity, wherein a relative position of the speaker assembly in the holder is adjustable during assembling.

2. The medical hearing-aid earphone of claim 1, wherein the holder comprises a first part and a second part connected to each other, the first part is provided with a first through hole, the speaker assembly is located in the first through hole, the second part is provided with a second through hole communicating with the first through hole, a cross-sectional dimension of the second through hole is smaller than a cross-sectional dimension of the first through hole, and the second through hole forms the front sound cavity.

3. The medical hearing-aid earphone of claim 2, wherein the second through hole comprises a first hole section, a transitional section and a second hole section, a cross-sectional dimension of the first hole section is larger than a cross-sectional dimension of the second hole section, and the first hole section communicates with the first through hole.

4. The medical hearing-aid earphone of claim 3, wherein the first through hole, the first hole section and the second hole section each are a cylindrical hole, and the transitional section is a conical hole.

5. The medical hearing-aid earphone of claim 2, wherein the housing comprises an upper housing and a lower housing connected to each other, the sound cavity is formed in the upper housing and the lower housing, the lower housing is internally provided with a support part, and the support part is matched with the second part to support the second part.

6. The medical hearing-aid earphone of claim 5, wherein the lower housing is provided a third through hole, and the medical hearing-aid earphone further comprises a sound output tube located in the third through hole, and a communicating tube for communicating the speaker assembly and the sound output tube, wherein the sound output tube is fixed on the holder.

7. The medical hearing-aid earphone of claim 6, wherein an outer surface of the holder is provided with a groove, and the communicating tube is located in the groove.

8. The medical hearing-aid earphone of claim 3, wherein the housing comprises an upper housing and a lower housing connected to each other, the sound cavity is formed in the upper housing and the lower housing, the lower housing is internally provided with a support part, and the support part is matched with the second part to support the second part.

9. The medical hearing-aid earphone of claim 8, wherein the lower housing is provided a third through hole, and the medical hearing-aid earphone further comprises a sound output tube located in the third through hole, and a communicating tube for communicating the speaker assembly and the sound output tube, wherein the sound output tube is fixed on the holder.

10. The medical hearing-aid earphone of claim 9, wherein an outer surface of the holder is provided with a groove, and the communicating tube is located in the groove.

11. The medical hearing-aid earphone of claim 4, wherein the housing comprises an upper housing and a lower housing connected to each other, the sound cavity is formed in the upper housing and the lower housing, the lower housing is internally provided with a support part, and the support part is matched with the second part to support the second part.

12. The medical hearing-aid earphone of claim 11, wherein the lower housing is provided a third through hole, and the medical hearing-aid earphone further comprises a sound output tube located in the third through hole, and a communicating tube for communicating the speaker assembly and the sound output tube, wherein the sound output tube is fixed on the holder.

13. The medical hearing-aid earphone of claim 12, wherein an outer surface of the holder is provided with a groove, and the communicating tube is located in the groove.

* * * * *